US009598902B2

(12) United States Patent
Hong et al.

(10) Patent No.: US 9,598,902 B2
(45) Date of Patent: Mar. 21, 2017

(54) AERIAL LADDER TRUCK

(71) Applicant: HO-RYONG CO., LTD., Gimje-si (KR)

(72) Inventors: Yong Hong, Jeonju-si (KR); Yong gil Kim, Gimje-si (KR)

(73) Assignee: Ho-Ryong Co., Ltd., Gimje-si (KR)

( * ) Notice: Subject to any disclaimer, the term of this patent is extended or adjusted under 35 U.S.C. 154(b) by 0 days.

(21) Appl. No.: 14/256,859

(22) Filed: Apr. 18, 2014

(65) Prior Publication Data

US 2015/0096835 A1 Apr. 9, 2015

(30) Foreign Application Priority Data

Oct. 4, 2013 (KR) ..... 10-2013-0118377

(51) Int. Cl.
*E06C 5/04* (2006.01)
*E06C 5/42* (2006.01)

(52) U.S. Cl.
CPC . *E06C 5/04* (2013.01); *E06C 5/42* (2013.01)

(58) Field of Classification Search
CPC ..... E06C 5/40; E06C 5/00; E06C 5/02; E06C 5/04; E06C 5/06; E06C 5/08; E06C 5/10; E06C 5/12; B66F 11/04; B66F 11/044; A62B 1/00; A62C 27/00
USPC ... 296/26.11, 26.15, 186.4, 61; 108/90, 206, 108/69–82
See application file for complete search history.

(56) References Cited

U.S. PATENT DOCUMENTS

| | | | | | |
|---|---|---|---|---|---|
| 2,026,535 | A | * | 1/1936 | Hooker | 182/180.3 |
| 2,777,737 | A | * | 1/1957 | Balogh | 182/1 |
| 3,072,215 | A | * | 1/1963 | Rush | 182/2.8 |
| 3,197,036 | A | * | 7/1965 | Mason | 212/231 |
| 3,262,517 | A | * | 7/1966 | Malec | 182/2.6 |
| 3,378,103 | A | * | 4/1968 | Zwight et al. | 182/141 |
| 3,572,467 | A | * | 3/1971 | Hall | 182/2.5 |
| 3,575,262 | A | * | 4/1971 | Way | 182/2.7 |
| 3,604,533 | A | * | 9/1971 | Eckels et al. | 182/46 |
| 3,817,007 | A | * | 6/1974 | Hall | 52/115 |
| 3,958,376 | A | * | 5/1976 | Campbell | 52/115 |
| 4,070,807 | A | * | 1/1978 | Smith, Jr. | 52/109 |
| 4,358,915 | A | * | 11/1982 | Pantalone | 52/115 |

(Continued)

*Primary Examiner* — Alvin Chin-Shue
*Assistant Examiner* — Shiref Mekhaeil
(74) *Attorney, Agent, or Firm* — Steptoe & Johnson LLP

(57) ABSTRACT

The present invention relates to an aerial ladder truck to allow the height of a rear end of an extensible ladder, which is a connection end thereof connected at the rear of a bed of the truck, to be freely adjusted so that articles may be loaded in a space below the extensible ladder and above the truck bed. The aerial ladder truck includes a vehicle having a bed at the rear thereof, a ladder turret provided to the bed to pass therethrough, an extensible post fixedly passing through the ladder turret and standing upright, the height of the top thereof being adjustable, an extensible ladder having a rear end connected to the top of the extensible post by means of a first hinge shaft so that the angle thereof is changeable, and a moving bucket provided at the top thereof, and an angle adjusting cylinder for changing the angle of the extensible ladder, the cylinder having a rear end connected at the front of the top of the extensible post by means of a second hinge shaft and a front end connected to the bottom of the extensible ladder by means of a third hinge shaft.

10 Claims, 18 Drawing Sheets

(56) References Cited

U.S. PATENT DOCUMENTS

| | | | | | |
|---|---|---|---|---|---|
| 4,407,419 | A * | 10/1983 | Clements | 212/304 |
| 4,499,841 | A * | 2/1985 | Lord | 114/98 |
| 4,511,015 | A * | 4/1985 | Purdy | 182/2.11 |
| 4,512,439 | A * | 4/1985 | Howell | 182/66.2 |
| 4,632,262 | A * | 12/1986 | Olsen et al. | 212/304 |
| 4,646,875 | A * | 3/1987 | Sholl | 182/2.6 |
| 4,775,029 | A * | 10/1988 | MacDonald et al. | 182/2.1 |
| 4,778,213 | A * | 10/1988 | Palmer | 296/26.11 |
| 4,944,364 | A * | 7/1990 | Blasko | 182/2.9 |
| 5,307,898 | A * | 5/1994 | Purdy et al. | 182/69.4 |
| 5,746,286 | A * | 5/1998 | Mlaker | 182/2.9 |
| 5,984,077 | A * | 11/1999 | Frye | B60P 1/36 198/317 |
| 6,048,018 | A * | 4/2000 | Shambeau et al. | 296/57.1 |
| 6,250,485 | B1 * | 6/2001 | Olson | 212/260 |
| 6,378,652 | B1 * | 4/2002 | Albert | 182/69.4 |
| 6,488,161 | B1 * | 12/2002 | Bean | 212/300 |
| 6,523,221 | B1 * | 2/2003 | Dahlin et al. | 15/314 |
| 6,598,702 | B1 * | 7/2003 | McGillewie et al. | 182/2.6 |
| 6,644,708 | B1 * | 11/2003 | Grzegorzewski et al. | 296/32 |
| 7,213,796 | B2 * | 5/2007 | Laforest | 254/1 |
| 8,215,241 | B2 * | 7/2012 | Garneau et al. | 108/20 |
| 8,579,525 | B2 * | 11/2013 | Chapman et al. | 396/428 |
| 8,690,514 | B2 * | 4/2014 | Marola | 414/563 |
| 2004/0016596 | A1 * | 1/2004 | Promersberger et al. | 182/2.9 |
| 2005/0236534 | A1 * | 10/2005 | Bondesen | 248/161 |
| 2010/0200328 | A1 * | 8/2010 | Savard et al. | 182/2.1 |

* cited by examiner

AERIAL LADDER TRUCK

FIELD OF THE INVENTION

The present invention relates to an aerial ladder truck, and more particularly to an aerial ladder truck to allow the height of a rear end of an extensible ladder, which is a connection end thereof connected at the rear of a bed of the truck, to be freely adjusted so that articles may be loaded in a space below the extensible ladder and above the truck bed.

BACKGROUND OF THE INVENTION

Generally, an aerial ladder truck is used for rescuing people or extinguishing fire in the event of a fire in a multistory building, or lifting up or taking down articles such as stuff packed for moving in an apartment or building, wherein a person rides in a bucket that moves along a multistage boom to rescue people or extinguish fire, and also to load and carry stuff in the bucket.

One example of a conventional aerial ladder truck is disclosed in Korean Patent No. 1251991, titled "AERIAL LADDER TRUCK" (hereinafter referred to as the "conventional aerial ladder truck").

The conventional aerial ladder truck includes a vehicle; a base frame mounted on the vehicle; a plurality of outriggers mounted on left and right sides at the front and rear of the base frame and telescopically extensible in multiple stages; a ladder apparatus mounted at the top of the base frame and provided with an extensible ladder; and a bucket mounted on the extensible ladder to move therealong.

The ladder apparatus includes a fixed ladder, one end of which is rotatably coupled to the base frame by means of a hinge shaft; an extensible ladder comprising a multi-stage ladder inserted inside the fixed ladder and slidably moving in multiple stages; and an angle adjusting cylinder for pivoting the fixed ladder upwardly and downwardly about the hinge shaft at a predetermined angle with respect to the base frame.

While the angle of the extensible ladder may be adjusted upwardly and downwardly as described above, the extensible ladder is also mounted at the top of a turntable mounted to pivot in a horizontal direction. That is, one end of the extensible ladder is connected at the top of the turntable by means of the hinge shaft, so that the angle thereof may be adjusted.

However, the conventional aerial ladder truck configured as above has the following problems.

First, the conventional aerial ladder truck has a problem in that no articles can be loaded in a space below the extensible ladder and above the base frame because the extensible ladder is inclined as one end thereof is fixed to the turntable by means of the hinge shaft.

Further, the conventional ladder truck has another problem in that the height of the truck may be restricted by a bridge, a pedestrian overpass or the like while driving the truck because the extensible ladder is inclined as one end thereof is fixed to the turntable by means of the hinge shaft, so that the height of the other end thereof is increased.

Furthermore, the conventional aerial ladder truck has yet another problem in that the extensible ladder may frequently fall down due to the weight of articles or a gust from outside or the like while carrying the articles because the extensible ladder is inclined as one end thereof is fixed to the turntable by means of the hinge shaft, so that the inclination thereof is increased while it is telescopically extended to carry the articles.

SUMMARY OF THE INVENTION

The present invention has been contrived to solve the above-mentioned problems of the prior art, and one object of the present invention is to provide an aerial ladder truck, wherein the height of a rear end of an extensible ladder, which is a connection end thereof connected at the rear of a bed of the truck, is freely adjusted so that articles may be loaded in a space below the extensible ladder and above the truck bed; the front height of the extensible ladder is lowered as the height of the rear end of the extensible ladder, which is the connection end thereof, is increased while driving the truck, so that the height of the truck may not restricted by a bridge or pedestrian overpass while driving the truck; and the inclination of the extensible ladder is reduced as the height of the rear end of the extensible ladder, which is the connection end thereof, is increased while it is telescopically extended to carry articles, thereby preventing the extensible ladder from falling down while the articles are carried in a bucket provided to the extensible ladder.

Further, another object of the invention is to provide an aerial ladder truck, wherein the height of the top of an extensible post is adjusted by means of a height adjusting cylinder operated by hydraulic pressure, so as to more stably adjust the height of the rear end of the extensible ladder.

Further, yet another object of the invention is to provide an aerial ladder truck, wherein the bottom of an elevating pipe is elevated or lowered as being latched onto the top of a fixed pipe or another elevating pipe, so as to prevent the elevating pipe from deviating from the fixed pipe or the other elevating pipe.

Further, still another object of the invention is to provide an aerial ladder truck, wherein the bottom of the extensible post is covered with a protection member, so as to prevent stones or the like bouncing up from the ground from directly colliding with the extensible post while driving the truck.

Further, still yet another object of the invention is to provide an aerial ladder truck, wherein the extensible post is rotated as a motor connected to the extensible post is rotated around a fixing gear fixed to the truck, so as to more stably rotate the extensible post.

Further, another object of the invention is to provide an aerial ladder truck, wherein articles are loaded onto the truck bed without falling therefrom by means of an auxiliary deck unit provided at the rear of the bed, so as to stably carry the articles while moving the truck; and when the articles are carried using the extensible ladder, the auxiliary deck unit is unfolded around the rear of the bed, so as to easily load and unload the articles onto and from the bucket.

Further, yet another object of the invention is to provide an aerial ladder truck, wherein two side plates and a rear plate constitute the auxiliary deck unit, and both ends of the rear plate may be firmly connected at the rear of the side plates.

Further, still another object of the invention is to provide an aerial ladder truck, wherein while the side plates and the rear plate constituting the auxiliary deck unit are horizontally unfolded, auxiliary rear plates may be further unfolded in a space between the rear of the side plates and the lateral of the rear plate.

Further, still yet another object of the invention is to provide an aerial ladder truck, wherein while the side plates constituting the auxiliary deck unit are erected upright, the front of the side plates may be firmly connected to vertical fixing posts standing upon the truck bed.

Further, another object of the invention is to provide an aerial ladder truck, wherein the side plates and the rear plate, which are heavyweight objects constituting the auxiliary deck unit, may be easily erected with less force.

In accordance with one aspect of the present invention to achieve the objects as described above, there is provided an aerial ladder truck, comprising: a vehicle having a bed at the rear thereof; a ladder turret provided to the bed to pass therethrough; an extensible post fixedly passing through the ladder turret and standing upright, the height of the top thereof being adjustable; an extensible ladder having a rear end connected to the top of the extensible post by means of a first hinge shaft so that the angle thereof is changeable, and a moving bucket provided at the top thereof; and an angle adjusting cylinder for changing the angle of the extensible ladder, the cylinder having a rear end connected at the front of the top of the extensible post by means of a second hinge shaft and a front end connected to the bottom of the extensible ladder by means of a third hinge shaft.

Further, the extensible post of the aerial ladder truck according to the invention comprises: a fixed pipe fixedly passing through the ladder turret and having an open top; at least one elevating pipe inserted inside the fixed pipe and telescopically elevated and lowered; a height adjusting cylinder provided between the bottom of the fixed pipe and the uppermost elevating pipe, and operated by hydraulic pressure to elevate and lower the at least one elevating pipe; and first and second hinge holes formed at the top of the uppermost elevating pipe so that the first and second hinge shafts are connected therethrough.

Further, the elevating pipe of the aerial ladder truck according to the invention is provided in plural, wherein a plurality of lower latching plates in the form of plates or bent plates are further provided at the bottom of an outer peripheral surface of the elevating pipes, and a plurality of upper latching plates in the form of plates or bent plates being latched onto the lower latching plates are further provided at the top of an inner peripheral surface of the at least one elevating pipe disposed at the bottom of the fixed pipe and the uppermost elevating pipe.

Further, the bottom of the extensible post of the aerial ladder truck according to the invention is further provided with a protection member comprising two side plates and a bottom plate fixedly connected to the bed to enclose and protect the bottom of the extensible post.

Further, the ladder turret of the aerial ladder truck according to the invention comprises: a through-hole formed in the bed; a ring-shaped fixing gear fixedly mounted around the bottom of the through-hole, wherein a mounting hole in which a ball insertion groove is formed on an inner peripheral surface thereof is centrally formed in the fixing gear, and a circumscribing gear is formed on an outer peripheral surface of the fixing gear; a ring-shaped rotating ring inserted in the mounting hole, wherein a ball insertion groove is formed on an outer peripheral surface of the rotating ring, and the extensible post centrally passes through the rotating ring; a plurality of sliding balls mounted in the ball insertion grooves in the fixing gear and the rotating ring to rotatably fix the rotating ring to the mounting hole of the fixing gear; a rotating plate horizontally fixed to an outer circumference of the extensible post to fix to the bottom of the rotating ring; and a driving gear provided at a circumference of the rotating plate to be rotated by means of a driving motor and engaged with the circumscribing gear of the fixing gear.

Further, the aerial ladder truck according to the invention further comprises an auxiliary deck unit provided at the rear of the bed and horizontally unfolded to an outer circumference of the rear of the bed.

Further, the auxiliary deck unit of the aerial ladder truck according to the invention comprises: two side plates provided at both sides of the bed, wherein lower ends thereof are fixedly connected to lateral ends of the bed through hinge units to allow the side plates to be horizontally unfolded to the outside of the both sides; a rear plate provided at the rear of the bed, wherein a lower end thereof is fixedly connected to a rear end of the bed through a hinge unit to allow the rear plate to be horizontally unfolded to the outside; and a first connection unit provided at the ends of both sides of the rear plate and at the rear of the outside of the side plates to separably connect both ends of the rear plate to the two side plates.

Further, the rear plate of the aerial ladder truck according to the invention further comprises auxiliary rear plates at both sides thereof, wherein the auxiliary rear plates are connected to both sides of the rear of the rear plate by means of the hinge units to be horizontally unfolded, and a groove in which a fixing hook is inserted is formed at a connection end of the hinge unit. A second connection unit for separably connecting the rear plate and unfolding ends of the auxiliary rear plates is further provided to each of the auxiliary rear plates and the rear plate to prevent the auxiliary rear plates from being unfolded while the auxiliary rear plates are folded in close contact with the rear of the rear plate. A protruding support is further provided at the rear of the outside of each side plate to support the auxiliary rear plates while the auxiliary rear plates are horizontally unfolded.

Further, the second connection unit of the aerial ladder truck according to the invention comprises a fixing hole formed at the unfolding ends of the auxiliary rear plates; and a locking shaft unit provided to the rear plate to separably connect to the fixing hole. The locking shaft unit comprises a fixing member fixed to the rear plate, wherein protruding brackets that protrude rearward are provided at the inside and outside of the fixing member, and a horizontal through-hole is formed in the protruding brackets; a horizontal locking shaft horizontally passing through both the protruding brackets to move to the left and right, wherein a stop ring is mounted between the protruding brackets at the inside and outside, and an outside end of the horizontal locking shaft is inserted into or separated from the fixing hole; and a spring elastically mounted to the horizontal locking shaft between the protruding bracket disposed at the outside and the stop ring to constantly press the horizontal locking shaft toward the fixing hole.

Further, the bed of the aerial ladder truck according to the invention further comprises vertical fixing posts at both sides thereof at the front of the side plates, wherein third connection units for separably connecting the side plates to the vertical fixing posts are further provided to the vertical fixing posts and the front of the side plates.

Further, the bed of the aerial ladder truck according to the invention further comprises at least one torsion spring unit at lateral ends thereof to apply force to erect the side plates while the horizontally unfolded side plates are erected upright. The torsion spring unit comprises a horizontal fixing shaft provided to protrude outwardly from the lateral ends of the bed; and a torsion spring inserted in the horizontal fixing shaft to constantly press a bottom outer surface of the side plates, wherein one end of the torsion spring is in close contact with a lateral bottom surface of the bed and the other end thereof is in close contact with the bottom outer surface of the side plates. The bed further comprises at least one torsion spring unit at a rear end thereof to apply force to erect the rear plate while the horizontally unfolded rear plate is erected upright. The torsion spring unit comprises a horizontal fixing shaft provided to protrude outwardly from the rear end of the bed; and a torsion spring inserted in the horizontal fixing shaft to constantly press a bottom outer surface of the rear plate, wherein one end of the torsion spring is in close contact with a rear bottom surface of the bed and the other end thereof is in close contact with the bottom outer surface of the rear plate.

As described above, the present invention may expand a load space of the truck bed by freely adjusting the height of a rear end of the extensible ladder, which is a connection end thereof connected at the rear of the bed, so that articles may be loaded in a space below the extensible ladder and above the bed; may provide convenience in driving the vehicle, by lowering the front height of the extensible ladder as the height of the rear end of the extensible ladder, which is the connection end thereof, is increased while driving the vehicle, so that the height of the truck may not be restricted by a bridge or pedestrian overpass while driving the vehicle; and may improve safety by reducing the inclination of the extensible ladder as the height of the rear end of the extensible ladder, which is the connection end thereof, is increased while it is telescopically extended to carry articles, thereby preventing the extensible ladder from falling down while the articles are carried in a bucket provided to the extensible ladder.

Further, the present invention may prevent the height of the extensible post from being accidentally changed while using the extensible ladder, by adjusting the height of the top of the extensible post by means of a height adjusting cylinder operated by hydraulic pressure to more stably adjust the height of the rear end of the extensible ladder.

Further, the present invention may prevent a malfunction of the extensible post caused by the deviation of the elevating pipe, by elevating or lowering the bottom of the elevating pipe as being latched onto the top of a fixed pipe or another elevating pipe, so as to prevent the elevating pipe from deviating from the fixed pipe or the other elevating pipe.

Further, the present invention may prevent a malfunction caused by damage to the bottom of the extensible post while driving the vehicle, by covering the bottom of the extensible post with a protection member so as to prevent stones or the like bouncing up from the ground from directly colliding with the extensile post while driving the vehicle.

Further, the present invention may provide rotational stability to the extensible ladder, by rotating the extensible post as a motor connected to the extensible post is rotated around a fixing gear fixed to the truck, so as to more stably rotate the extensible post.

Further, the present invention may allow articles to be stably carried while moving the truck, by loading the articles onto the truck bed so that the articles may not fall therefrom by means of an auxiliary deck unit provided at the rear of the bed, and may provide convenience in loading or unloading articles onto or from a bucket, by unfolding the auxiliary deck unit around the rear of bed when the articles are carried using the extensible ladder.

Further, the present invention may prevent the side plates and the rear plate, which stand upright and constitute the auxiliary deck unit, from being unfolded while driving the vehicle, by firmly connecting both ends of the rear plate and the rear of the side plates.

Further, the present invention may further expand a utility space of the auxiliary deck unit, by further unfolding the auxiliary rear plates in a space between the rear of the side plates and the lateral of the rear plate while the side plates and the rear plate constituting the auxiliary deck unit are horizontally unfolded.

Further, the present invention may prevent the side plates from being unfolded while driving the vehicle, by firmly connecting the front of the side plates to vertical fixing posts standing upright upon the truck bed while the side plates constituting the auxiliary deck unit are erected upright.

Further, the present invention may provide usability by allowing the side plates and the rear plate, which are heavyweight objects constituting the auxiliary deck unit, to be easily erected with less force.

BRIEF DESCRIPTION OF THE DRAWINGS

FIGS. 1A and 1B are side views illustrating an aerial ladder truck according to the present invention, in which FIG. 1A shows a state in which an extensible post is lowered, and FIG. 1B shows a state in which the extensible post is elevated;

FIGS. 2A and 2B illustrate the rear of the aerial ladder truck according to the present invention, in which FIG. 2A shows a state in which an extensible ladder is connected, and FIG. 2B shows a state in which the extensible ladder is omitted;

FIGS. 4A-4E illustrate the ladder turret and the extensible post according to the present invention, in which FIG. 4A is a sectional view taken along a line A-A of FIG. 2A, FIG. 4B is an enlarged view showing a portion B in FIG. 4A, FIG. 4C is an enlarged view showing a portion C in FIG. 4A, FIG. 4D is a sectional view taken along a line D-D of FIG. 4A, and FIG. 4E is a sectional view taken along a line E-E of FIG. 4A;

FIGS. 9A-9D are enlarged views illustrating a connection part of the auxiliary deck unit, in which FIG. 9A shows the connection part viewed from F of FIG. 8, FIG. 9B is an enlarged perspective view schematically illustrating a torsion spring unit provided at the lateral of a bed, FIG. 9C shows the connection part viewed from F of FIG. 8, and FIG. 9D is an enlarged perspective view schematically illustrating a torsion spring unit provided at a rear end of the bed.

DETAILED DESCRIPTION OF THE PREFERRED EMBODIMENTS

Hereinafter, preferred embodiments of the present invention will be described in detail with reference to the accompanying drawings. The accompanying drawings are merely intended to illustrate the technical idea of the invention in more detail, and are not to be construed as limiting the technical idea of the invention. It will be understood by those skilled in the art that various modifications and changes may be made therefrom.

Figure 1A:
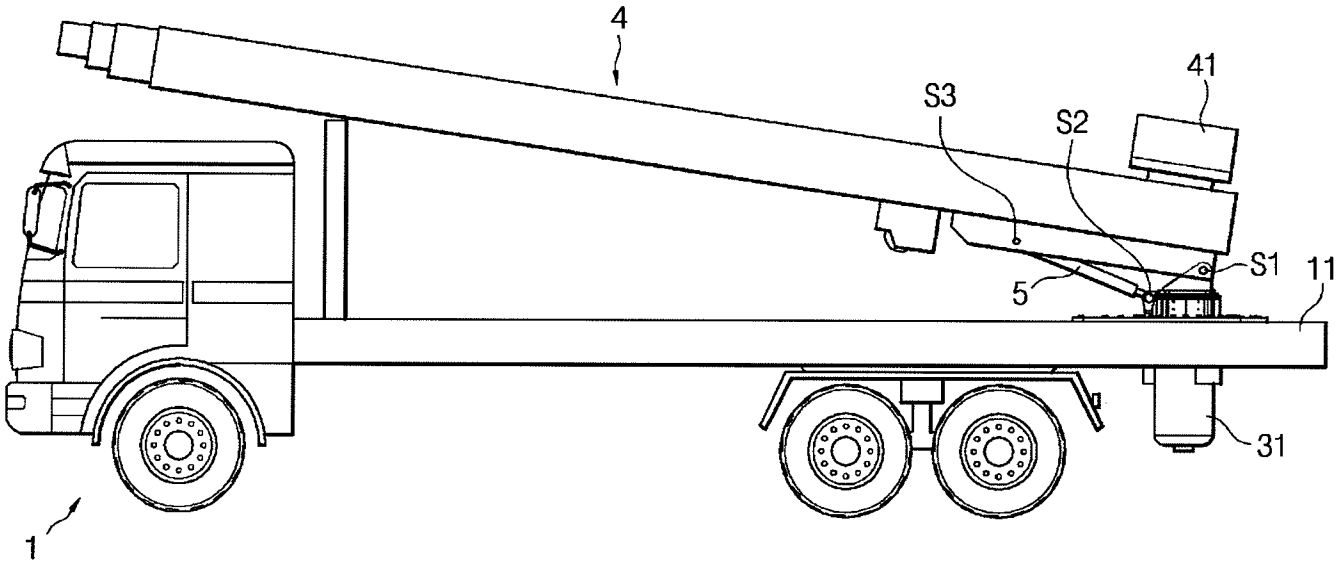
Figure 1B:
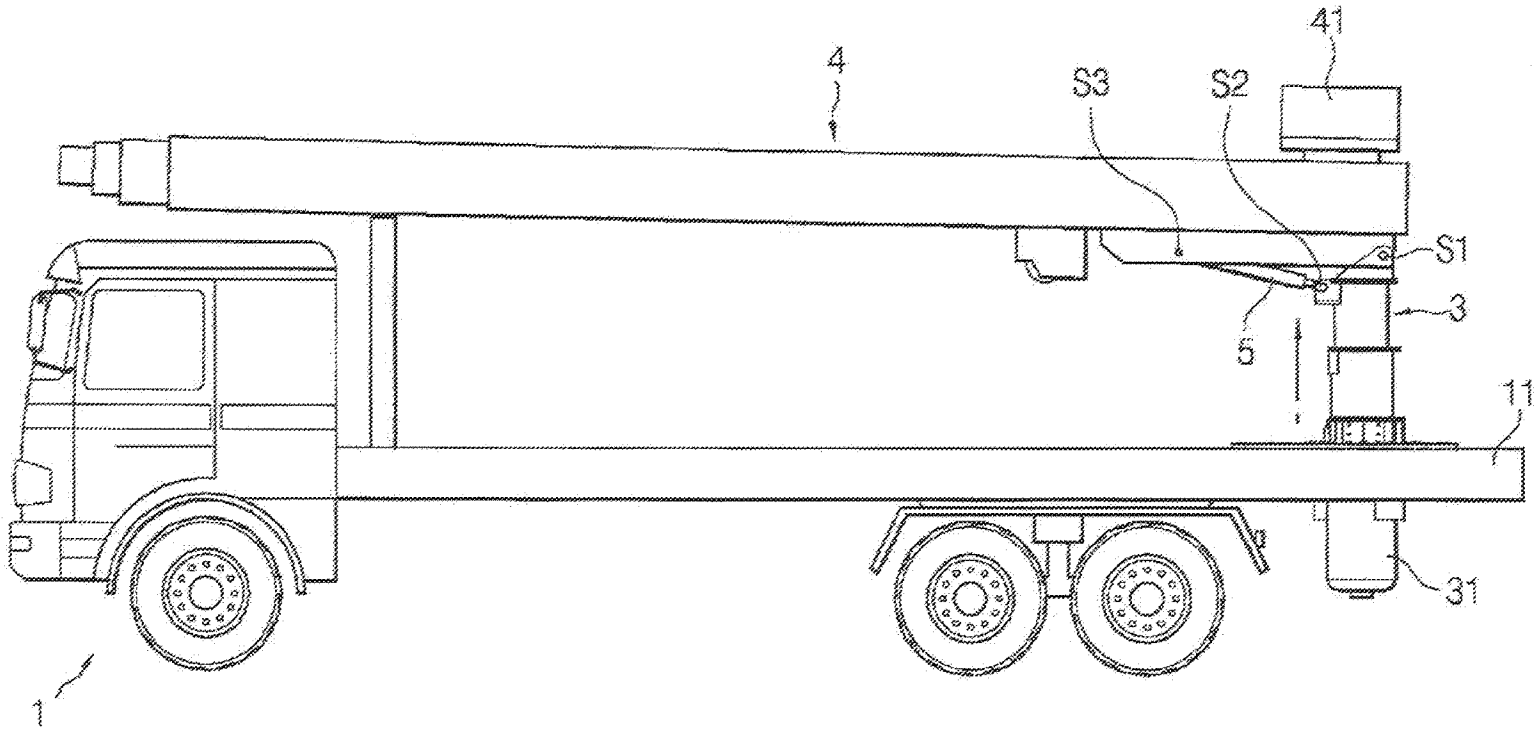
Figure 2A:
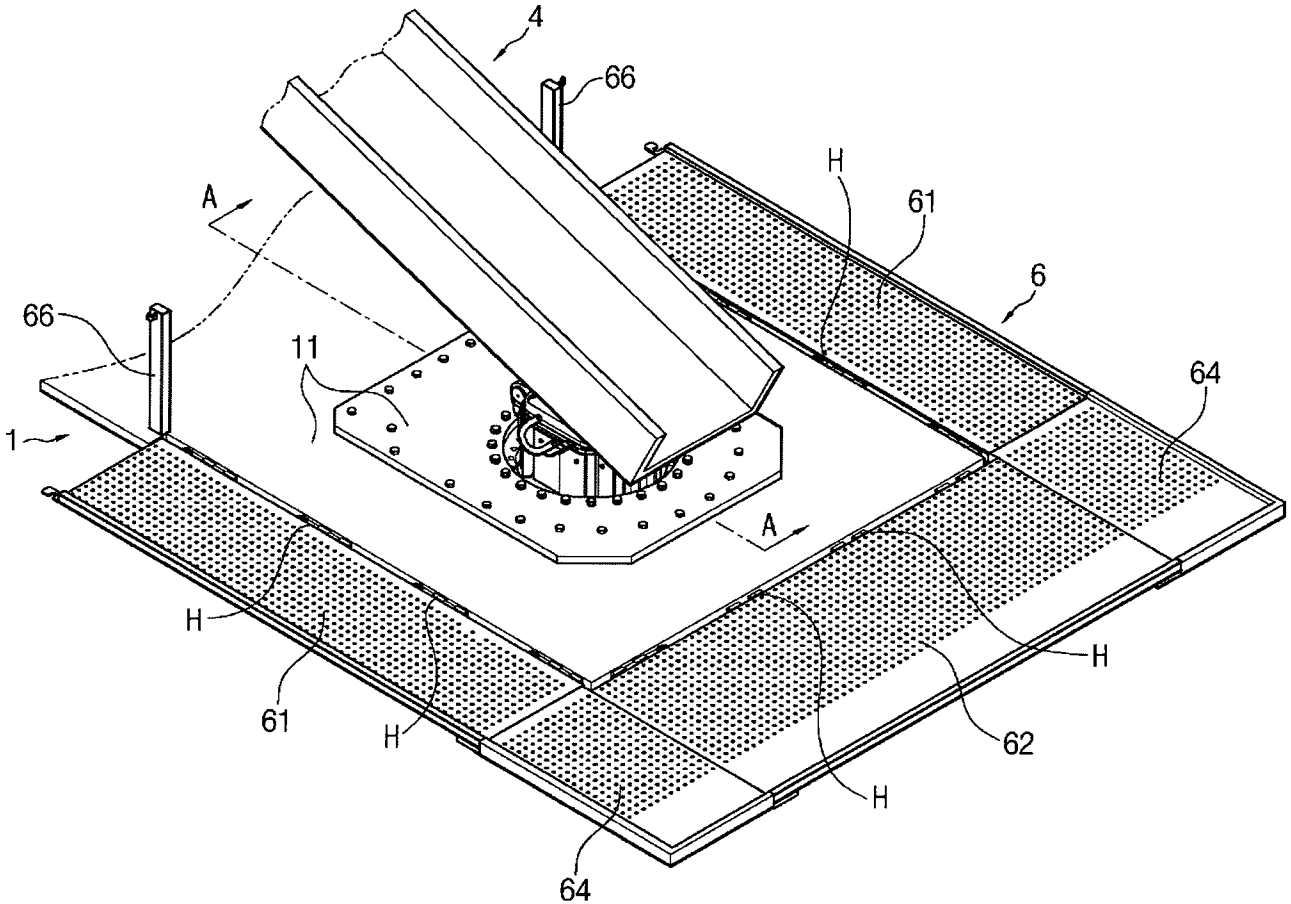
Figure 2B:
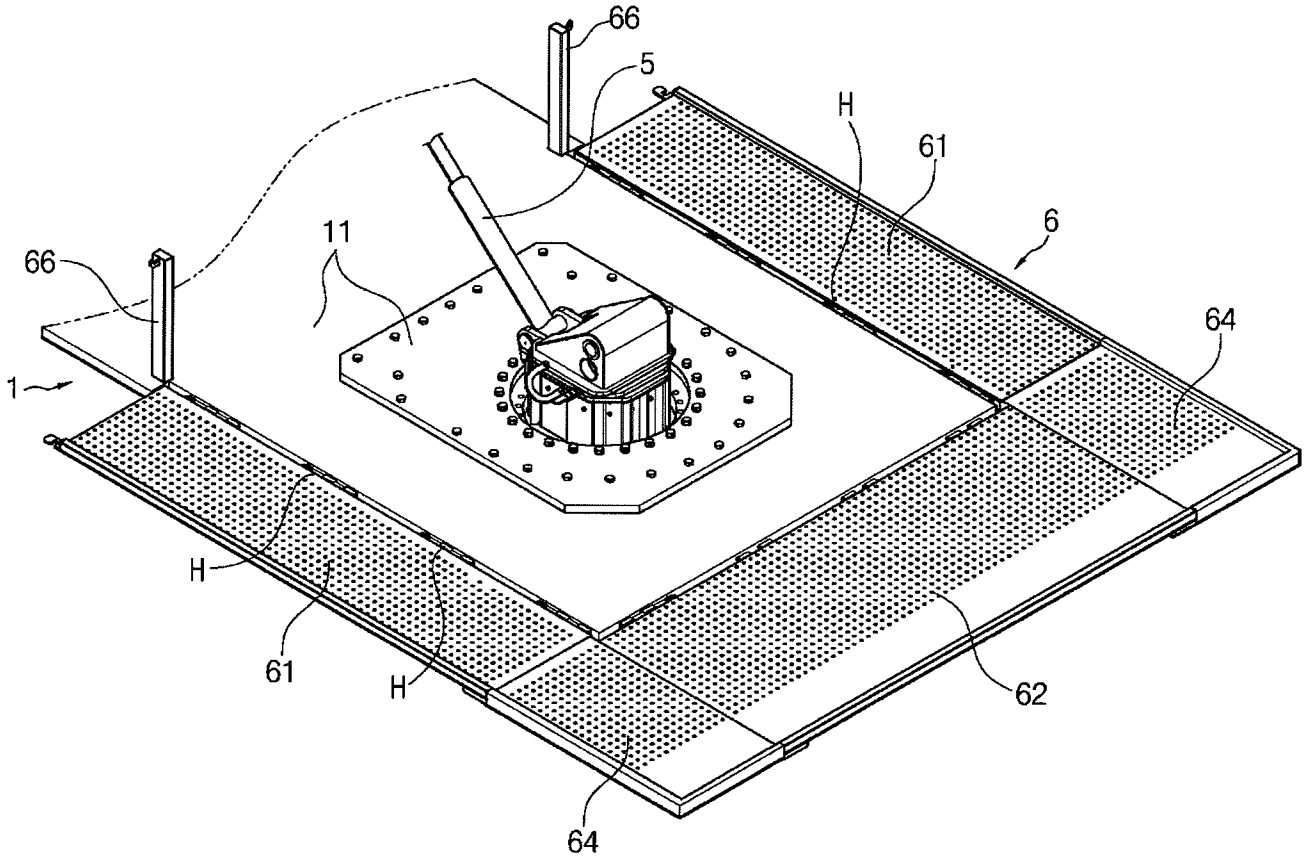
Figure 3:
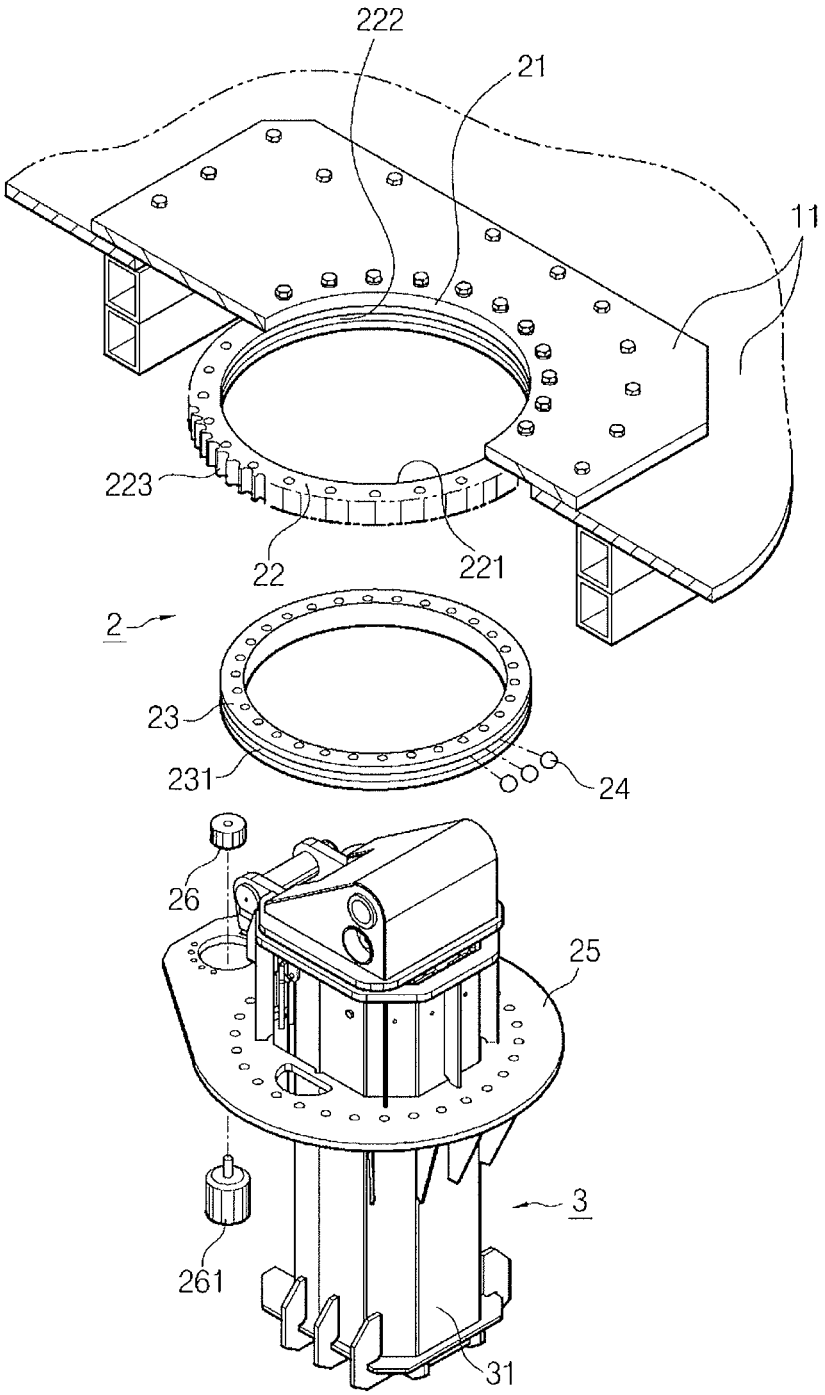
FIG. 3 is an exploded perspective view illustrating a ladder turret according to the present invention.
Figure 4A:
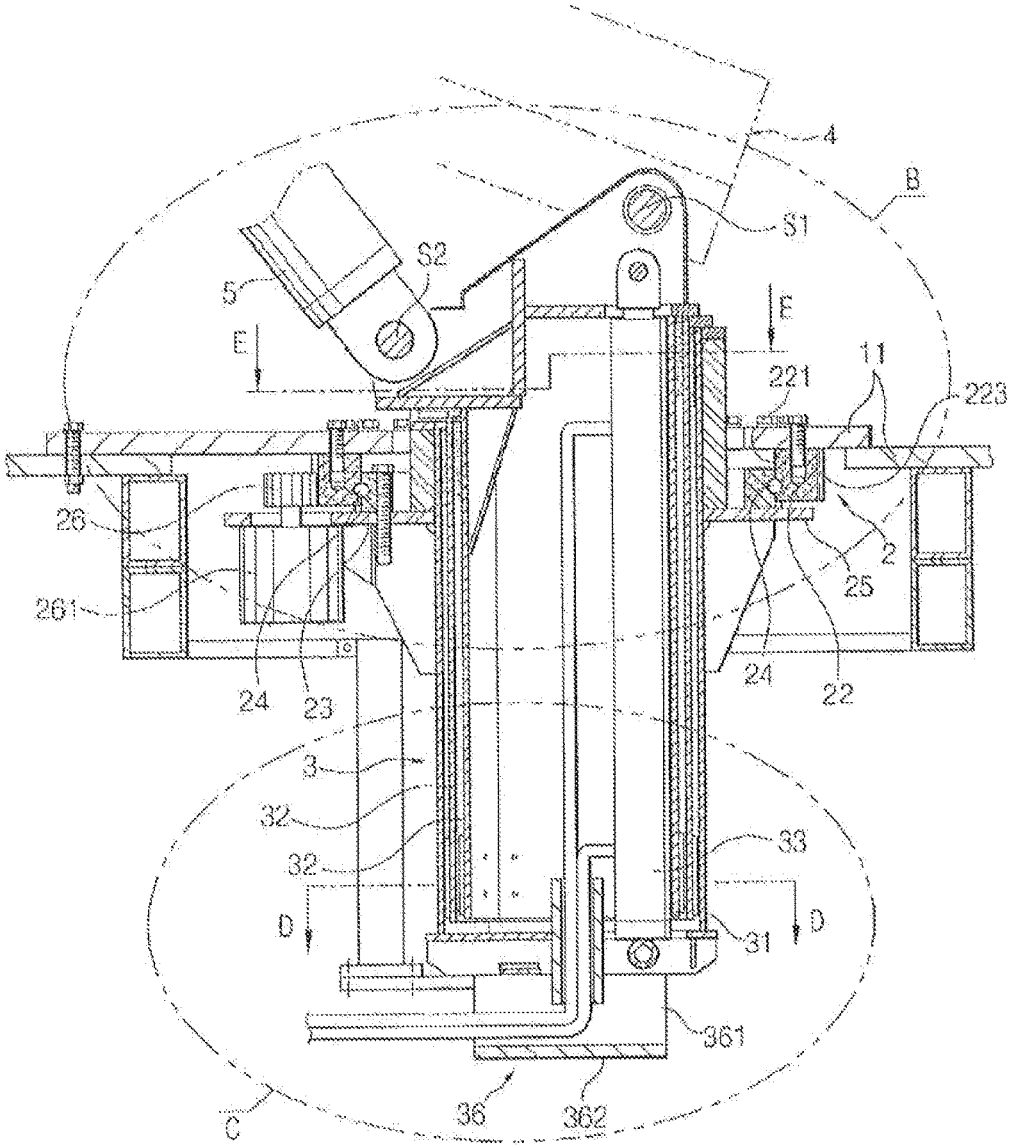
Figure 4B:
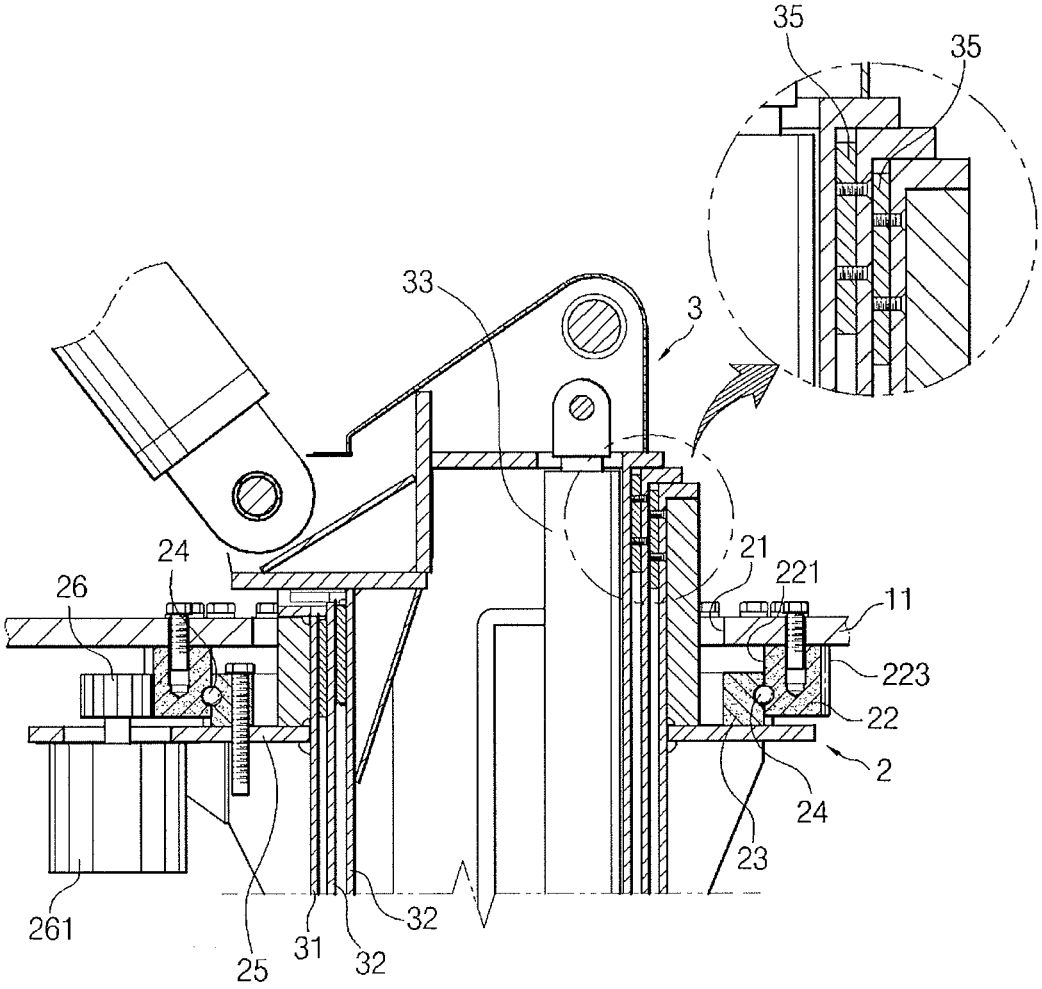
Figure 4C:
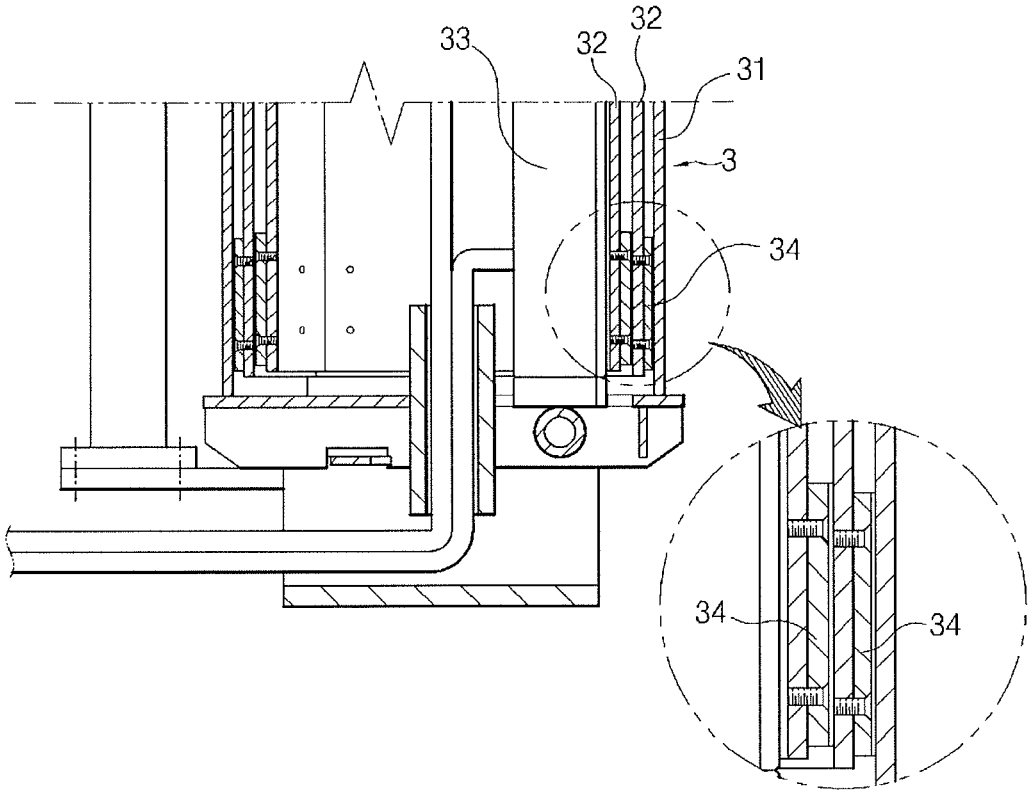
Figure 4D:
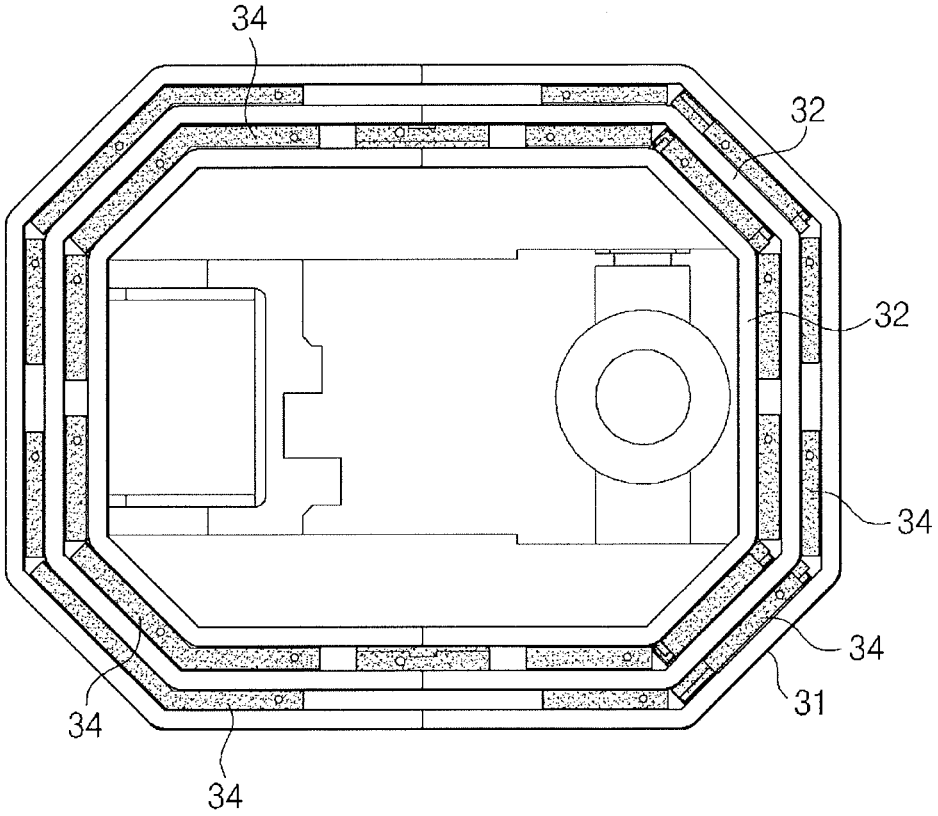
Figure 4E:
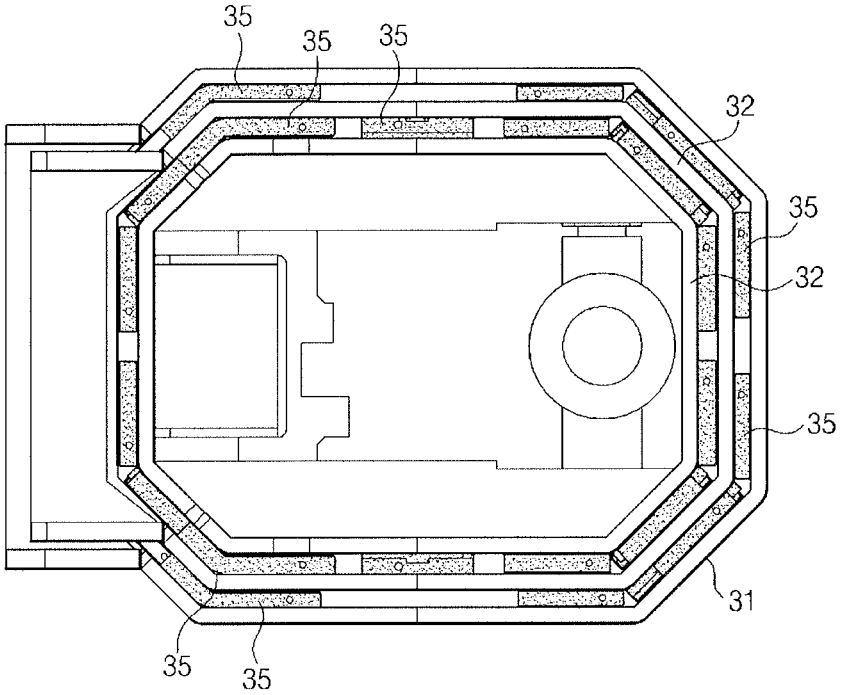

FIGS. 1A and 1B are side views illustrating an aerial ladder truck according to the present invention, in which FIG. 1A shows a state in which an extensible post is lowered, and FIG. 1B shows a state in which the extensible post is elevated. Further, FIGS. 2A and 2B illustrate the rear of the aerial ladder truck according to the present invention, in which FIG. 2A shows a state in which an extensible ladder is connected, and FIG. 2B shows a state in which the extensible ladder is omitted. In addition, FIG. 3 is an exploded perspective view illustrating a ladder turret according to the present invention, and FIGS. 4A-4E illustrate the ladder turret and the extensible post according to the present invention, in which FIG. 4A is a sectional view taken along a line A-A of FIG. 2A, FIG. 4B is an enlarged view showing a portion B in FIG. 4A, FIG. 4C is an enlarged view showing a portion C in FIG. 4A, FIG. 4D is a sectional view taken along a line D-D of FIG. 4A, and FIG. 4E is a sectional view taken along a line E-E of FIG. 4A.

As shown in the drawings, the aerial ladder truck of the present invention comprises a vehicle 1 having a bed 11 at the rear thereof; a ladder turret 2 provided to the bed 11 to pass therethrough; an extensible post 3 fixedly passing through the ladder turret 2; an extensible ladder 4 having a rear end being connected to the top of the extensible post 3; and an angle adjusting cylinder 5 provided between the extensible post 3 and the extensible ladder 4.

The vehicle 1 comprises the bed 11, which is provided at the rear thereof, and the left, right and rear sides of the bed 11 are open. Vehicles such as the vehicle 1 are already known in the art.

As shown in FIGS. 1-4, the ladder turret 2 according to the invention is provided to and passes through the bed 11 at the rear of the vehicle 1, and serves to rotate the extensible post 3 centrally passing therethrough, thereby rotating the rear end of the extensible ladder 4 to rotate the extensible ladder 4 as a whole.

The ladder turret 2 as described above comprises a through-hole 21 formed in the bed 11; a fixing gear 22 fixedly mounted around the bottom of the through hole 21, wherein a mounting hole 221 in which a ball insertion groove 222 is formed on an inner peripheral surface thereof is centrally formed in the fixing gear, and a circumscribing gear 223 is formed on an outer peripheral surface of the fixing gear; a ring-shaped rotating ring 23 inserted in the mounting hole 221, wherein a ball insertion groove 231 is formed on an outer peripheral surface of the rotating ring 23, and the extensible post 3 centrally passes through the rotating ring 23; a plurality of sliding balls 24 mounted in the ball insertion grooves 222 and 231 in the fixing gear 22 and the rotating ring 23; a rotating plate 25 horizontally fixed to an outer circumference of the extensible post 3 to fix to the bottom of the rotating ring 23; and a driving gear 26 provided at a circumference of the rotating plate 25 to be rotated by means of a driving motor 261 and engaged with the circumscribing gear 223 of the fixing gear 22.

Preferably, the fixing gear 22 is fixed by means of a plurality of bolts to the bed 11 around the bottom of the through-hole 21, so that it may be easily mounted. The fixing gear 22 is preferably configured in a ring shape to allow the rotating ring 23 to smoothly rotate in the mounting hole 221.

Preferably, the rotating ring 23 has an outer diameter smaller than an inner diameter of the mounting hole 221 of the fixing gear 22 to smoothly rotate in the mounting hole 221. Further, the rotating ring 23 is preferably fixed around the rotating plate 25 by means of a plurality of bolts, so that it may be easily mounted to the rotating plate 25.

The sliding balls 24 are mounted in the ball insertion grooves 222 and 231 in the fixing gear 22 and the rotating ring 23 to rotatably fix the rotating ring 23 to the mounting hole 221 of the fixing gear 22. Further, the sliding balls 24 as described above are preferably provided all around the rotating ring 23 so that the rotating ring 23 is firmly assembled to the mounting hole 221 of the fixing gear 22.

The rotating plate 25 is horizontally fixed to the outer circumference of the extensible post 3 to rotate together with the rotation ring 23 and the extensible post 3. Further, a protrusion is formed around the rotating plate 25 to fix the driving gear 26 and the driving motor 261, so that the driving motor 261 is fixed to the bottom of the protrusion and a rotating shaft of the driving motor 261 protrudes from the top of the protrusion. In addition, the driving gear 26 is mounted on the rotating shaft of the driving motor 261, wherein the driving gear 26 rotates while engaging with the circumscribing gear 223 of the fixing gear 22 and moves in a circular trace along the circumference of the driving gear 26.

Accordingly, the driving motor 261 connected to the extensible post 3 through the rotating plate 25 rotates in a circular trace along the circumference of the fixing gear 22, thereby rotating the driving motor 261 and the extensible post 3 together. Therefore, rotational stability of the extensible ladder 4 may be advantageously secured by directly transmitting the rotational force of the driving motor 261 to the extensible post 3.

Figure 5:
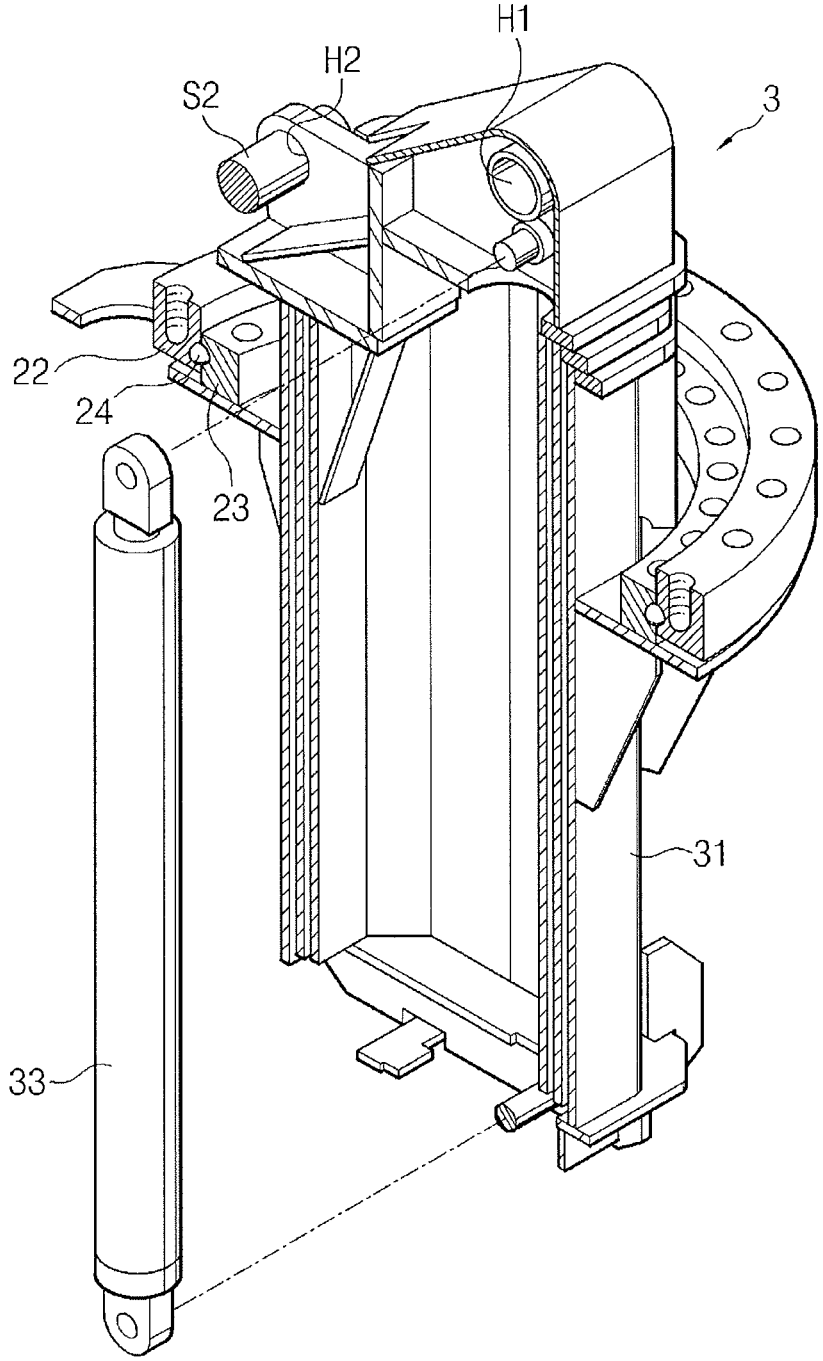
FIG. 5 is a perspective sectional view partially illustrating the interior of the extensible post according to the present invention.
Figure 6:
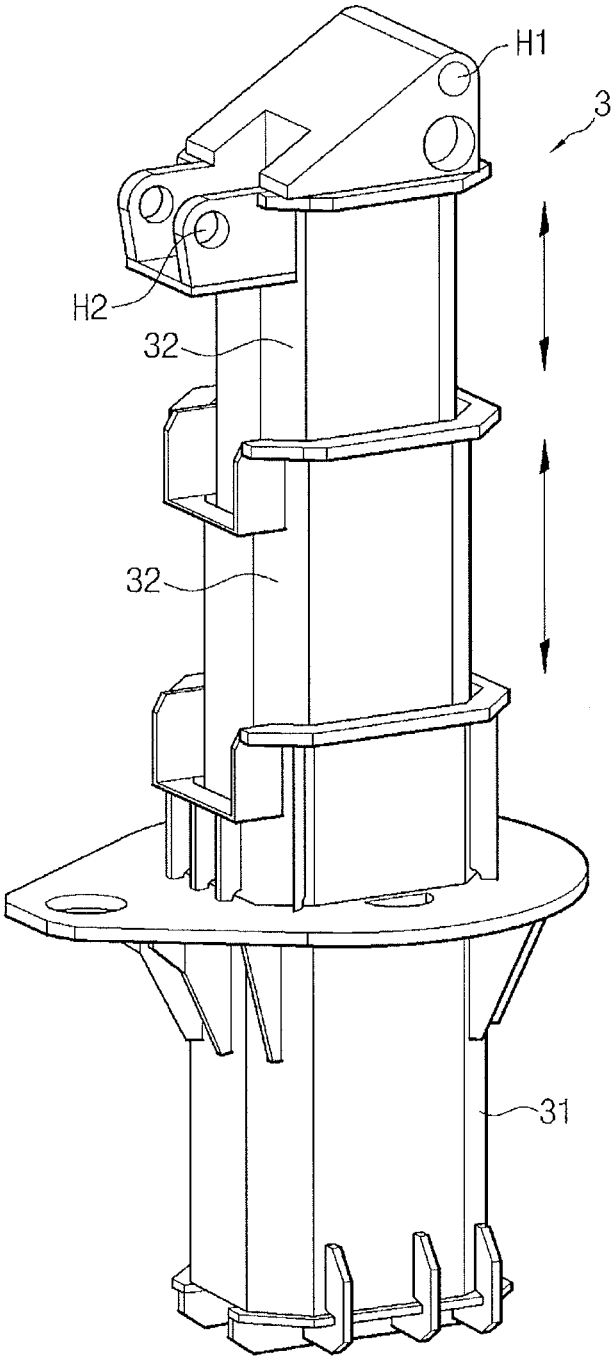
FIG. 6 is a perspective view schematically illustrating a state in which the extensible post according to the present invention is elevated.
Figure 7:
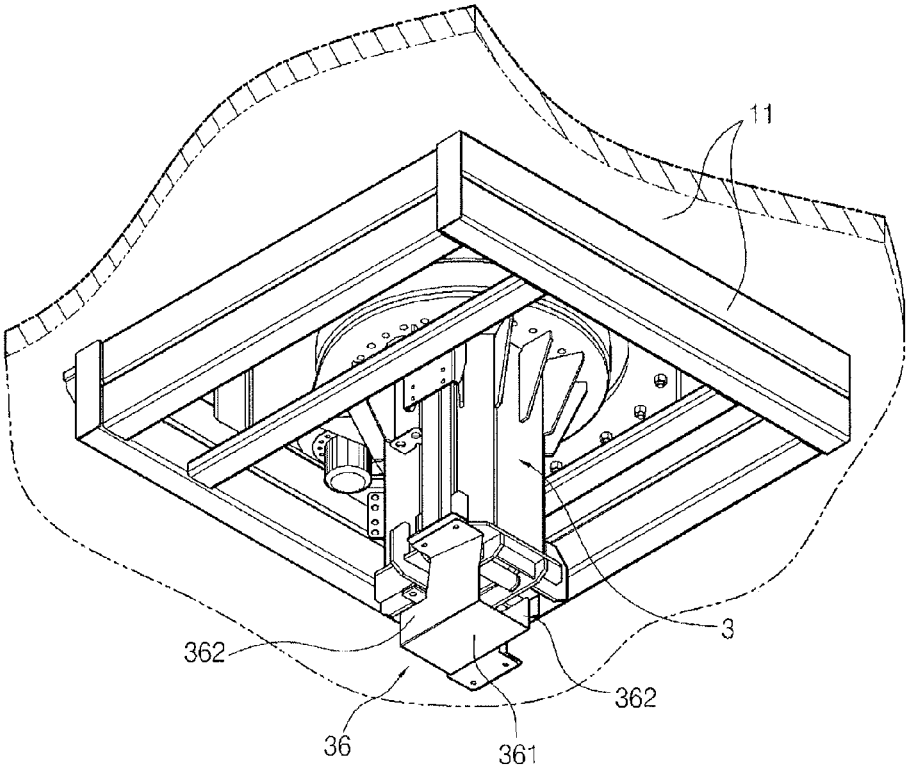
FIG. 7 is a perspective view illustrating a protection member according to the present invention from the bottom thereof.

FIG. 5 is a perspective sectional view partially illustrating the interior of the extensible post according to the present invention, FIG. 6 is a perspective view schematically illustrating a state in which the extensible post according to the present invention is elevated, and FIG. 7 is a perspective view illustrating a protection member according to the present invention from the bottom thereof.

As shown in FIGS. 1-6, the extensible post 3 according to the invention fixedly passes through the ladder turret 2 to stand upright, wherein the height of the top thereof is adjustable so that the height of the rear end of the extensible ladder 4, which is a connection part of the extensible ladder 4 and the extensible post 3, may be freely adjusted.

The extensible post 3 as described above comprises a fixed pipe 31 fixedly passing through the ladder turret 2 and having an open top; at least one elevating pipe 32 inserted inside the fixed pipe 31 and telescopically elevated and lowered; a height adjusting cylinder 33 provided between the bottom of the fixed pipe 31 and the uppermost elevating pipe 32 to elevate and lower the at least one elevating pipe 32; and first and second hinge holes H1 and H2 formed at the top of the uppermost elevating pipe 32 so that first and second hinge shafts S1 and S2 are connected therethrough.

The fixed pipe 31 and the elevating pipe 32 are preferably configured as a polygonal pipe such as a tetragonal pipe so that the elevating pipe 32 may not be elevated or lowered with no traction, and it is shown in the accompanying drawings that the elevating pipe 32 is configured as a tetragonal pipe.

The height adjusting cylinder 33 serves to elevate or lower the elevating pipe 32, and it is preferable to use a hydraulic cylinder operated by hydraulic pressure to prevent the elevated position of the elevating pipe 32 from being changed. Further, a fluid line is used as means for supplying oil to the height adjusting cylinder 33, and is preferably provided to pass through the bottom of the fixed pipe 31 constituting the extensible post 3. In addition, a vertical pipe through which the fluid line passes may be further provided at the bottom of the fixed pipe 31 to protect the fluid line.

The first hinge shaft S1 connected at the rear end of the extensible ladder 4 passes through the first hinge hole H1 so that the angle of the extensible ladder 4 may be changed, and the hinge shaft S2 connected at the rear end of the angle adjusting cylinder 5 passes through the second hinge hole H2 so that the angle of the angle adjusting cylinder 5 may be changed.

Accordingly, by adjusting the height of the top of the extensible post 3 by means of the height adjusting cylinder 33 operated by hydraulic pressure, the height of the rear end of the extensible ladder 4 may be stably adjusted. Therefore, the present invention may advantageously prevent the height of the extensible post 3 from being accidentally changed while unfolding and using the extensible ladder 4, by adjusting the height of the extensible post 3 by hydraulic pressure.

Meanwhile, a plurality of lower latching plates 34 in the form of plates or bent plates may be further provided at the bottom of an outer peripheral surface of the elevating pipes 32, and a plurality of upper latching plates 35 in the form of plates or bent plates being latched onto the lower latching plates 34 may be further provided at the top of an inner peripheral surface of the at least one elevating pipe 32 disposed at the bottom of the fixed pipe 31 and the uppermost elevating pipe 32. Accordingly, since the bottom of one elevating pipe 32 is elevated or lowered as being latched onto the top of the fixed pipe 31 or another elevating pipe 32, the present invention may advantageously prevent the elevating pipe 32 from deviating from the fixed pipe 31 or the other elevating pipe 32.

In addition, as shown in FIGS. 4 and 7, the bottom of the extensible post 3 may be further provided with a protection member 36 comprising two side plates 361 and a bottom plate 362 fixedly connected the bed 11 to enclose and protect the bottom of the extensible post 3. Therefore, the present invention may advantageously prevent a malfunction caused by damage to the bottom of the extensible post 3 while driving the vehicle 1, by covering the bottom of the extensible post 3 with the protection member 36 to prevent stones or the like bouncing up from the ground from directly colliding with the extensible post 3 while driving the vehicle 1.

As shown in FIGS. 1A and 1B, the rear end of the extensible ladder 4 according to the invention is connected to the top of the extensible post 3 by means of the first hinge shaft S1, so that the angle thereof may be changed, and a moving bucket 41 is provided at the top of the extensible ladder 4.

The extensible ladder 4 comprises a lowermost boom provided with the first hinge shaft S1; a plurality of booms telescopically mounted to the lowermost boom; and the bucket 41 moving along the top of the booms. Extensible ladders such as the extensible ladder 4 configured as above are already known in the art, and thus the detailed description thereof will be omitted.

Furthermore, as shown in FIGS. 1 and 2, the angle adjusting cylinder 5 according to the invention has a rear end being connected at the front of the top of the extensile post 3 by means of the hinge shaft S2, and a front end being connected to the bottom of the extensible ladder 4 by means of a hinge shaft S3, thereby serving to change the angle of the extensible ladder 4. However, cylinders such as the angle adjusting cylinder 5 are already known in the art, and thus the detailed description thereof will be omitted.

Figure 8:
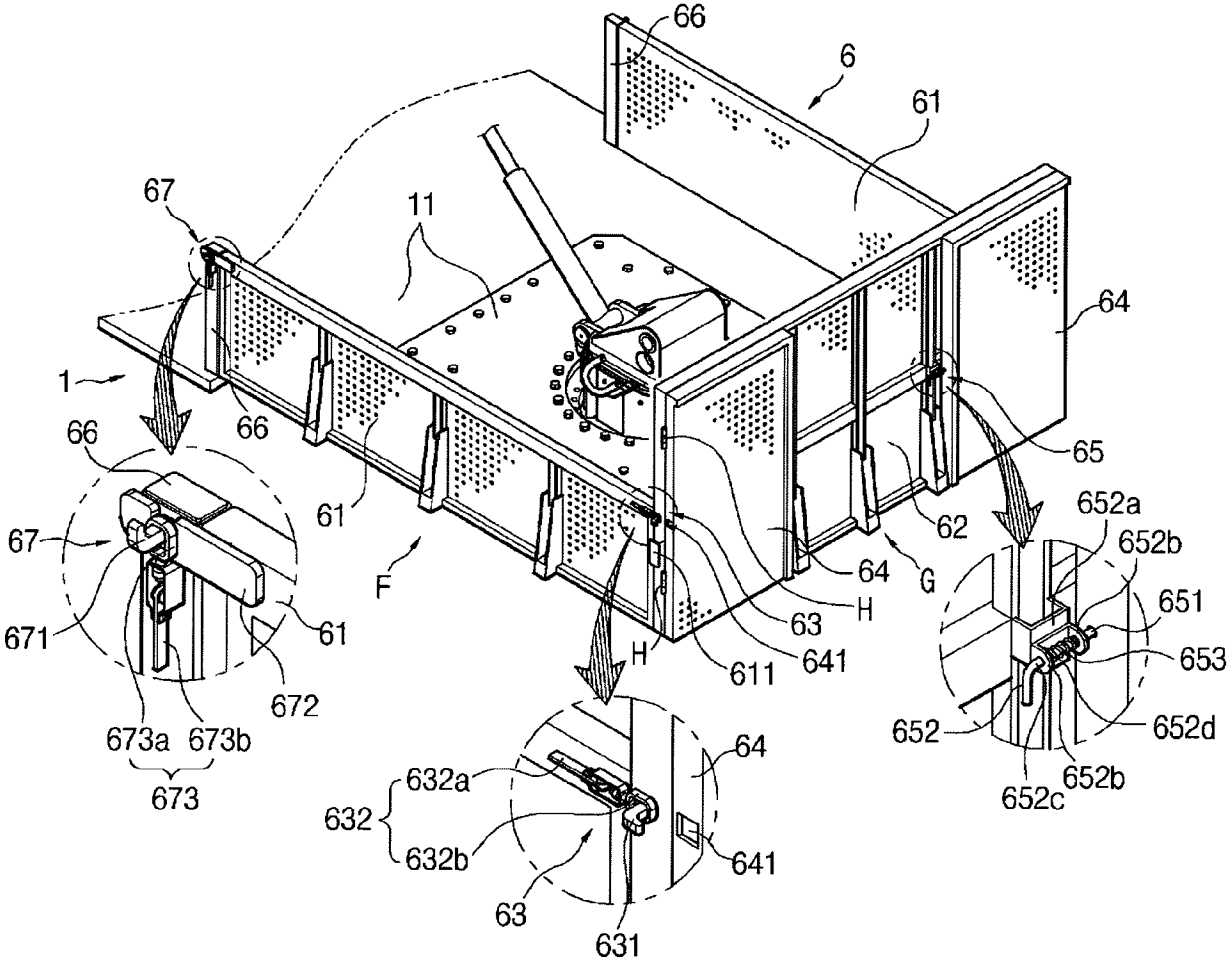
FIG. 8 is a perspective view illustrating a state in which an auxiliary deck unit according to the present invention is folded.

FIG. 8 is a perspective view illustrating a state in which an auxiliary deck unit according to the present invention is folded.

As shown in FIGS. 2 and 8, the aerial ladder truck according to the invention may further comprise an auxiliary deck unit 6 provided at the rear of the bed 11 and horizontally unfolded to an outer circumference of the rear the bed 11. The auxiliary deck unit 6 allows articles to be loaded onto the rear of the bed 11 of the vehicle 1 so that the articles may not fall therefrom, and provides convenience in loading or unloading articles onto or from the bucket 41 when unfolded.

The auxiliary deck unit 6 as described above comprises two side plates 61 provided at both sides of the bed 11, wherein lower ends thereof are fixedly connected to lateral ends of the bed 11 through hinge units H to allow the side plates to be horizontally unfolded to the outside of the both sides; a rear plate 62 provided at the rear of the bed 11, wherein a lower end thereof is fixedly connected to a rear end of the bed 11 through a hinge unit H to allow the rear plate to be horizontally unfolded to the outside; and a first connection unit 63 provided at the ends of both sides of the rear plate 62 and at the rear of the outside of the side plates 61 to separably connect both ends of the rear plate 62 to the side plates 61.

The first connection unit 63 comprises a fixing hook 631 formed at the end of the lateral of the rear plate 62, and a locking latch unit 632 provided at the rear of the outside of the side plates 61 and separably latched and connected to the fixing hook 631. The locking latch unit 632 comprises a rotating handle 632*a* rotatably connected to the outside of the side plate 61 by means of a hinge shaft, and a latching ring 632*b* connected to the rotating handle 632*a* and separably latched onto the fixing hook 631 by the rotation of the rotating handle 632*a*. Locking latch units such as the locking latch unit 632 are already known in the art, and thus the detailed description thereof will be omitted.

Thus, the present invention may advantageously prevent the side plates 61 and the rear plate 62, which stand upright and constitute the auxiliary deck unit 6, from being unfolded while driving the vehicle 1, by firmly connecting both ends of the rear plate 62 and the rear of the side plates 61 by means of the first connection unit 63. In addition, the present invention may advantageously allow the articles loaded onto the bed 11 of the vehicle 1 to be stably carried while moving the vehicle 1, by loading the articles onto the rear of the bed 11 so that the articles may not fall therefrom when the side plates 61 and the rear plate 62 constituting the auxiliary deck unit 6 are erected upright. Further, the present invention may advantageously provide convenience in loading or unloading articles when the articles are carried using the extensible ladder 4, by horizontally unfolding the side plates 61 and the rear plate 62 constituting the auxiliary deck unit 6.

Furthermore, the rear plate 62 may further comprise auxiliary rear plates 64 at both sides thereof, wherein the auxiliary rear plates 64 are connected to both sides of the rear of the rear plate 62 by means of the hinge units H to be horizontally unfolded, and a groove 641 in which the fixing hook is inserted is formed at a connection end of the hinge unit H. A second connection unit 65 for separably connecting the rear plate 62 and unfolding ends of the auxiliary rear plates 64 may be further provided to each of the auxiliary rear plates 64 and the rear plate 62 to prevent the auxiliary rear plates 64 from being unfolded while the auxiliary rear plates 64 are folded in close contact with the rear of the rear plate 62. A protruding support 611 may be further provided at the rear of the outside of each side plate 61 to support the auxiliary rear plates 64 while the auxiliary rear plates 64 are unfolded horizontally.

Meanwhile, the second connection unit 65 comprises a fixing hole 651 formed at the unfolding ends of the auxiliary rear plates 64; and a locking shaft unit 652 provided to the rear plate 62 to separably connect to the fixing hole 651. Further, the locking shaft unit 652 comprises a fixing member 652*a* fixed to the rear plate 62, wherein protruding brackets 652*b* protruding rearward are provided at the inside and outside of the fixing member 652*a*, and a horizontal through-hole 21 is formed in the protruding brackets 652*b*; a horizontal locking shaft 652*c* horizontally passing through both the protruding brackets 652*b* to move to the left and right, wherein a stop ring 652*d* is mounted between the protruding brackets 652*b* at the inside and outside, and an outside end of the horizontal locking shaft 652*c* is inserted in or separated from the fixing hole 651; and a spring 653 elastically mounted to the horizontal locking shaft 652*c* between the protruding bracket 652*b* disposed at the outside and the stop ring 652*d* to constantly press the horizontal locking shaft 652*c* toward the fixing hole 651.

Accordingly, the present invention may advantageously further expand a utility space of the auxiliary deck unit 6, by further unfolding the auxiliary rear plates 64 in a space between the rear of the side plates 61 and the lateral of the rear plate 62 while the side plates 61 and the rear plate 62 constituting the auxiliary deck unit 6 are horizontally unfolded.

Further, vertical fixing posts 66 may be further provided at both sides of the bed 11 at the front of the side plates 61, wherein third connection units 67 for separably connecting the side plates 61 to the vertical fixing posts 66 may be further provided to the vertical fixing posts 66 and the front of the side plates 61. The third connection unit 67 comprises a fixing hook 671 protruding outwardly from the top of the vertical fixing post 66; a fixing through-plate 672 provided to protrude frontward from the top of the outer front of the side plate 61 and inserted in the fixing hook 671 to pass therethrough; and a locking latch unit 673 provided at the top of the vertical fixing post 66 and separably latched and connected to the fixing hook 671 to prevent the deviation of the fixing through-plate 672. The locking latch unit 673 comprises a rotating handle 673*a* rotatably connected to the outside of the vertical post 66 by means of a hinge shaft, and a latching ring 673*b* connected to the rotating handle 673*a* and separably latched onto the fixing hook 671 by the rotation of the rotating handle 673*a*. Locking latch units such as the locking latch unit 673 are already known in the art, and thus the detailed description thereof will be omitted.

Accordingly, the present invention may advantageously prevent the side plates 61 from being unfolded while driving the vehicle 1, by firmly connecting the front of the side plates 61 to the vertical fixing posts 66 standing upright upon the bed 11 of the vehicle 1 while the side plates 61 constituting the auxiliary deck unit 6 are erected upright.

Figure 9A:
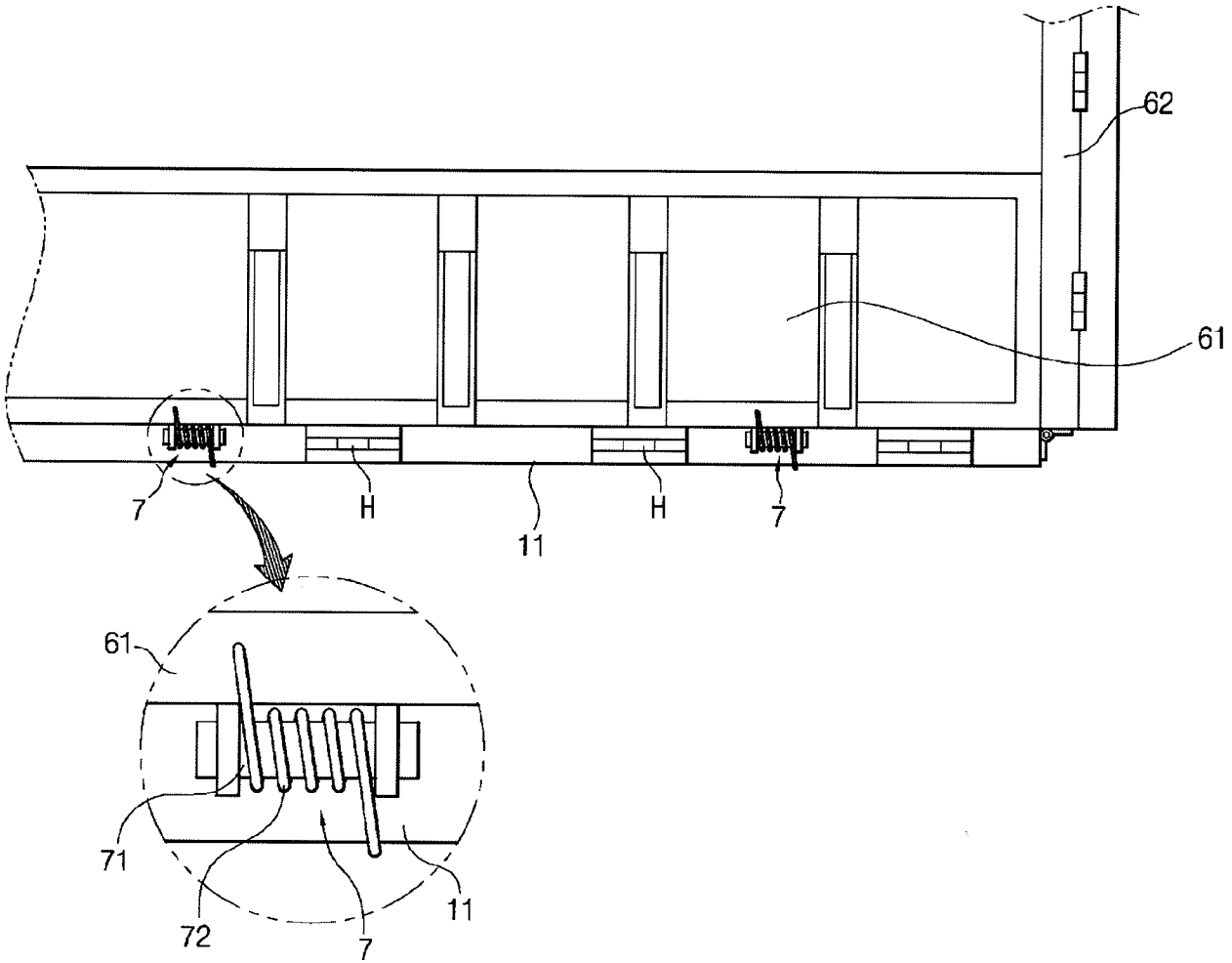
Figure 9B:
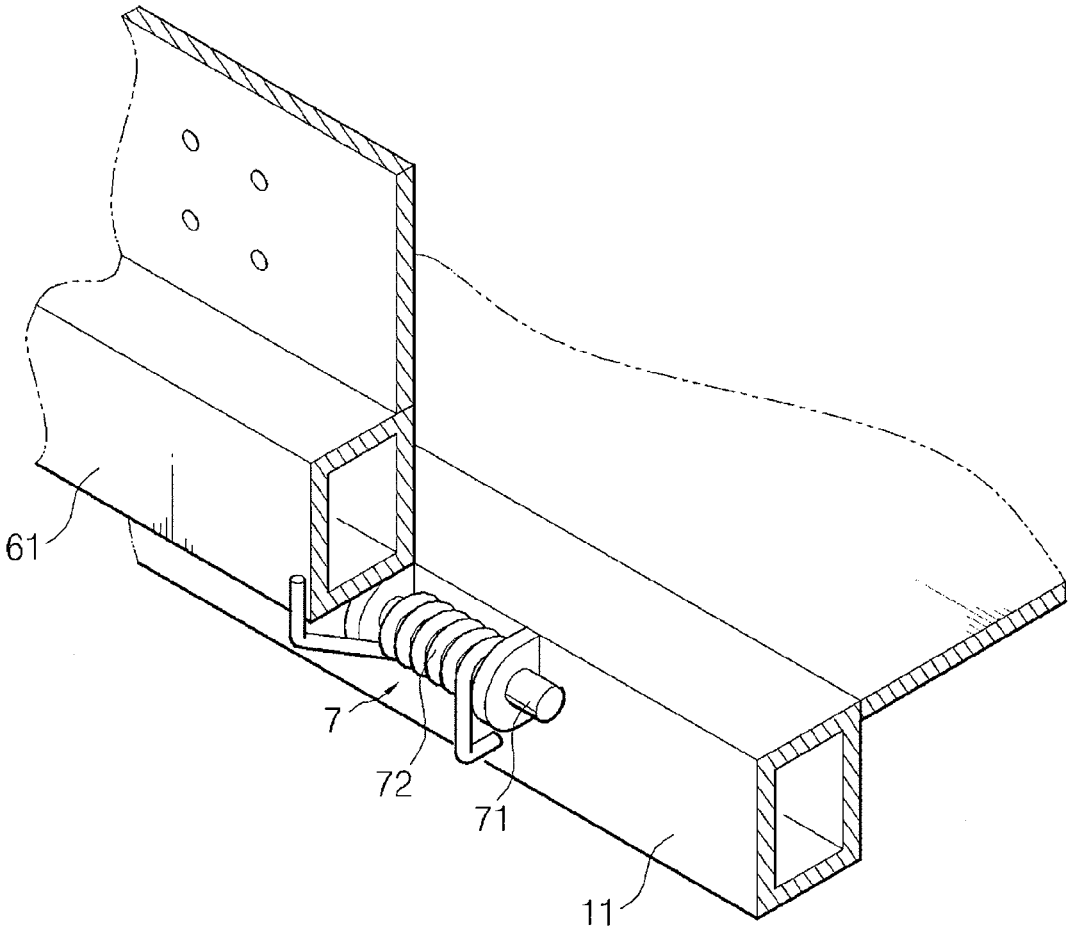
Figure 9C:
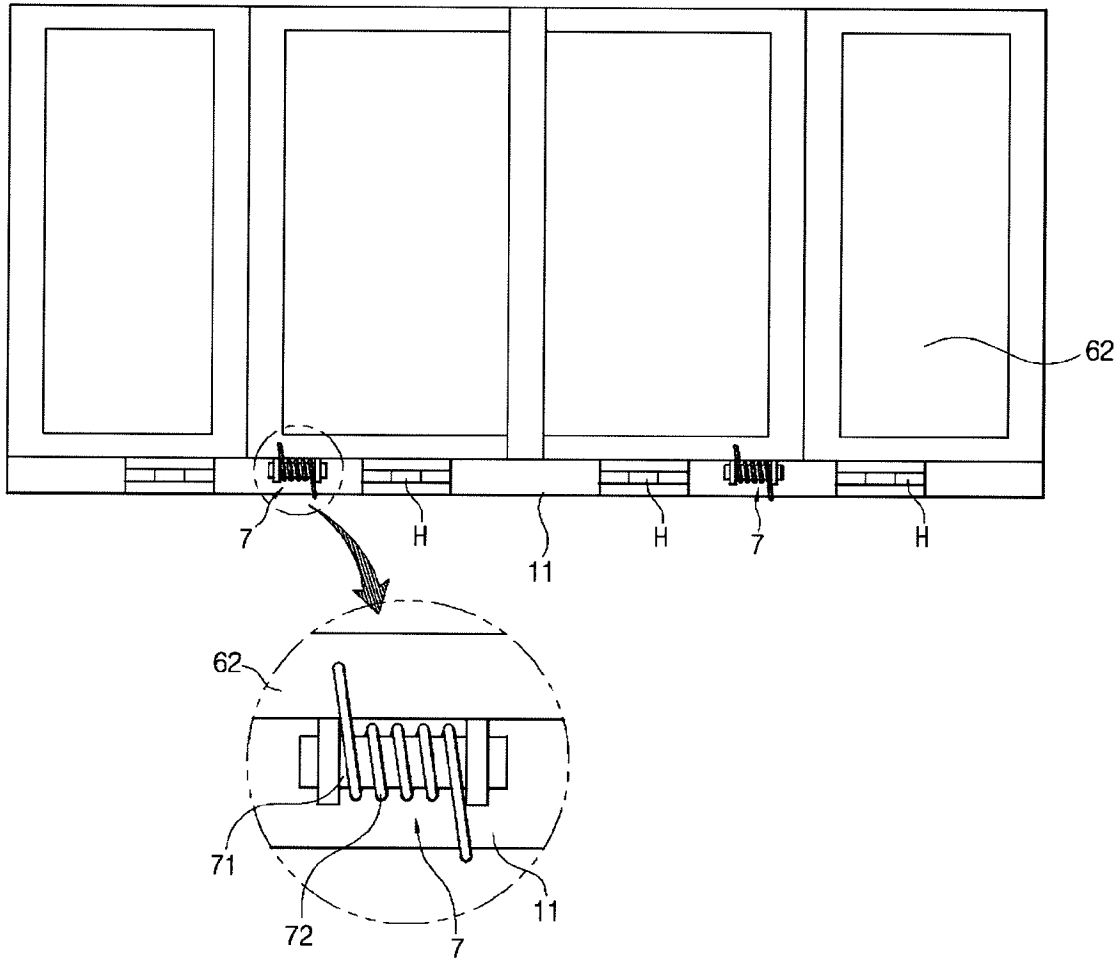
Figure 9D:
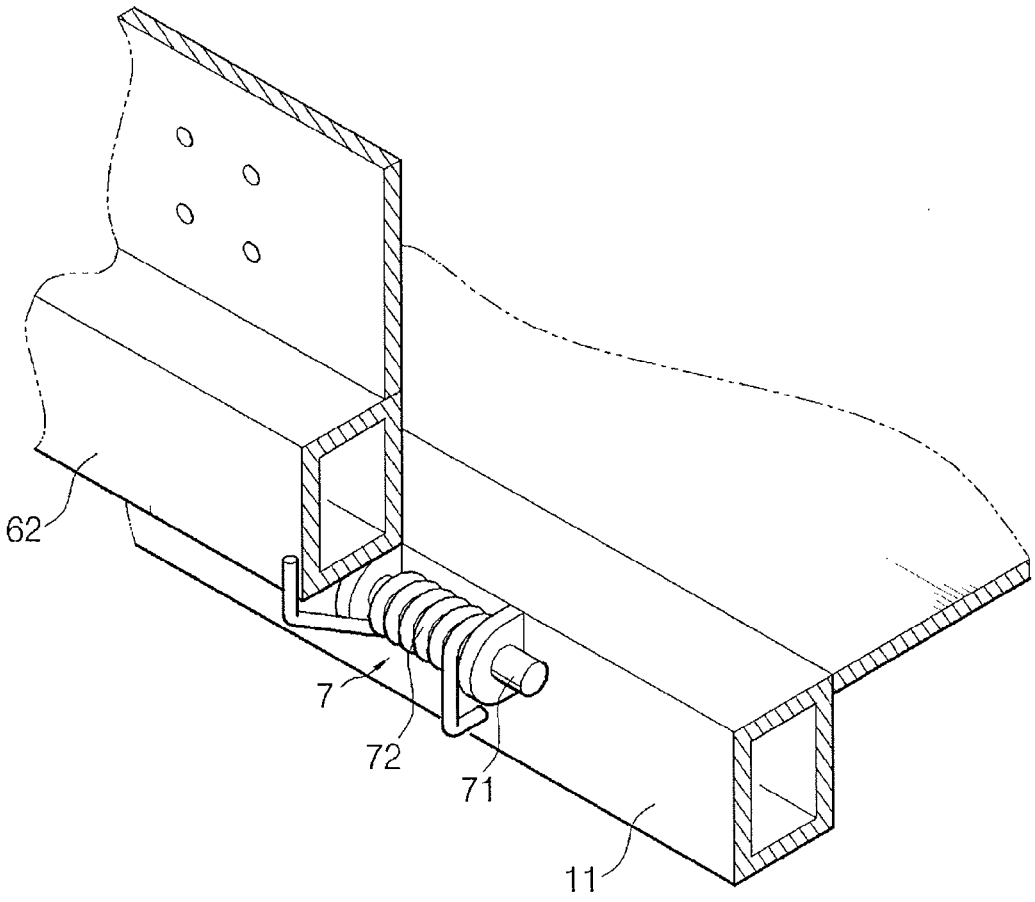

FIGS. 9A-9D are enlarged views illustrating a connection part of the auxiliary deck unit according to the invention, in which FIG. 9A shows the connection part viewed from F of FIG. 8, FIG. 9B is an enlarged perspective view schematically illustrating a torsion spring unit provided at the lateral of the bed, FIG. 9C shows the connection part viewed from F of FIG. 8, and FIG. 9D is an enlarged perspective view schematically illustrating a torsion spring unit provided at a rear end of the bed.

As shown in FIGS. 2, 8, 9A and 9B, in the aerial ladder truck according to the invention, at least one torsion spring unit 7 may be further provided at lateral ends of the bed 11 to apply force to erect the side plates 61 while the horizontally unfolded side plates 61 are erected upright.

The torsion spring unit 7 comprises a horizontal fixing shaft 71 provided to protrude outwardly from the lateral ends of the bed 11; and a torsion spring 72 inserted in the horizontal fixing shaft 71 to constantly press a bottom outer surface of the side plates 61, wherein one end of the torsion spring 72 is in close contact with a lateral bottom surface of the bed 11 and the other end thereof is in close contact with the bottom outer surface of the side plates 61.

As described above, the torsion spring 72 constantly presses the bottom outer surface of the side plates 61, thereby additionally applying force to the side plates 61 when a worker erects the heavyweight side plates 61 while the side plates 61 are unfolded. Accordingly, the present invention may advantageously allow the worker to erect the side plates 61 with less force. Further, the torsion spring 72 constantly presses the bottom outer surface of the side plates 61, thereby preventing the heavyweight side plates 61 from being abruptly laid down while the upright side plates 61 are horizontally unfolded. Thus, the present invention may advantageously prevent the worker from being injured.

As shown in FIGS. 2, 8, 9C and 9D, in the aerial ladder truck according to the invention, at least one torsion spring unit 7 may be further provided at a rear end of the bed 11 to apply force to erect the rear plate 62 while the horizontally unfolded rear plate 62 is erected upright.

The torsion spring unit 7 comprises a horizontal fixing shaft 71 provided to protrude outwardly from the rear end of the bed 11; and a torsion spring 72 inserted in the horizontal fixing shaft 71 to constantly press a bottom outer surface of the rear plate 62, wherein one end of the torsion spring 72 is in close contact with a rear bottom surface of the bed 11 and the other end thereof is in close contact with the bottom outer surface of the rear plate 62.

As described above, the torsion spring 72 constantly presses the bottom outer surface of the rear plate 62, thereby additionally applying force to the rear plate 62 when a worker erects the heavyweight rear plate 62 while the rear plate 62 is unfolded. Accordingly, the present invention may advantageously allow the worker to erect the rear plate 62 with less force. Further, the torsion spring 72 constantly presses the bottom outer surface of the rear plate 62, thereby preventing the heavyweight rear plate 62 from being abruptly laid down while the upright rear plate 62 is horizontally unfolded. Thus, the present invention may advantageously prevent the worker from being injured.

Hereinafter, the operation of the aerial ladder truck of the invention configured as above will be described.

First, as shown in FIGS. 1-6, when the aerial ladder truck of the invention is driven on a road, the height adjusting cylinder 33 of the extensible post 3 provided at the rear of the bed 11 is operated to elevate the elevating pipe 32, thereby increasing the height of the rear end of the extensible ladder 4. Then, as the rear end of the extensible ladder 4 is elevated, the height of the front of the extensible ladder 4 is lowered. Accordingly, the present invention may advantageously provide convenience in driving the aerial ladder truck, by lowering the front height of the extensible ladder 4 as the height of the rear end of the extensible ladder 4, which is the connection end thereof, is increased while driving the vehicle 1, so that the height of the truck may not be restricted by a bridge or pedestrian overpass while driving the vehicle 1.

Further, the aerial ladder truck of the invention may advantageously expand a load space of the bed 11 of the vehicle 1, by increasing the height of the rear end of the extensible post 3, which is the connection end thereof, as described above so that articles may be loaded in a space below the extensible ladder 4 and above the bed 11 of the vehicle 1.

In addition, the aerial ladder truck of the invention may advantageously prevent the extensible ladder 4 from accidentally falling down while articles are carried in the bucket 41 provided to the extensible ladder 4, by reducing the inclination of the extensible ladder 4 while the extensible ladder 4 is telescopically extended to carry the articles as the height of the rear end of the extensible post 3, which is the connection end thereof, is increased as described above.

Although the aerial ladder truck according to the present invention has been described in detail with reference to the preferred embodiments of the invention, the present invention is not limited thereto and the scope of the invention should be determined and defined by the accompanying claims.

Further, it will be understood by those skilled in the art that various modifications and changes may be made from the description of the present invention without departing from the scope of the invention.

What is claimed is:

1. An aerial ladder truck comprising:

a cab;

a bed (11) having a vertical depth dimension and extending rearwardly from the cab;

a ladder turret (2) adjacent a rear end of the bed (11) away from the cab, and passing through and beyond the entire vertical depth dimension of the bed, said ladder turret (2) comprising:

a through-hole (21) formed in the bed (11);

a ring-shaped fixing gear (22) fixedly mounted around the bottom of the through-hole (21), wherein a mounting hole (221) in which a first ball insertion groove (222) is formed on an inner peripheral surface thereof, is centrally formed in the fixing gear (22), and a circumscribing gear is formed on an outer peripheral surface of the fixing gear (22);

a ring-shaped rotating ring (23) in the mounting hole (221), wherein a second ball insertion groove (231) is formed on an outer peripheral surface of the rotating ring (23), and the extensible post 3 centrally passes through the rotating ring (23);

a plurality of sliding balls (24) mounted in the first and second ball insertion grooves (222) and (231) in the fixing gear (22) and the rotating ring (23) to rotatably fix the rotating ring (23) to the mounting hole (221) of the fixing gear (22);

a rotating horizontal plate (25) fixed to an outer circumference of the extensible post (3) to fix to the bottom of the rotating ring (23); and a driving gear (26) at a circumference of the rotating plate (25) for rotation by a driving motor (261), and engaged with the circumscribing gear (223) of the fixing gear (22);

an extensible post (3) fixedly passing through the ladder turret (2), said post standing vertically upright, and having a top, a bottom, an adjustable height between said top and bottom, the top having a front facing a front end of the bed;

an extensible ladder (4) having a rear end connected to the top of the extensible post (3) by a first hinge shaft; and an angle adjusting cylinder (5) for changing an angle of elevation of the extensible ladder (4), the cylinder (5) having a rear end connected at the front of the top of the extensible post (3) by a second hinge shaft, and a front end connected to the bottom of the extensible ladder (4) by a third hinge shaft.

2. The aerial ladder truck as claimed in claim 1, wherein the extensible post 3 comprises:

a fixed pipe (31) fixedly passing through the ladder turret (2) and having a bottom and an open top;

at least one elevating pipe (32) having upper and lower ends, and inserted inside the fixed pipe (31) and telescopically elevatable, and lowerable so that the lower end approaches the bottom of fixed pipe (31);

a height adjusting cylinder (33) between the bottom of the fixed pipe (31) and the upper end of said elevating pipe (32), and operable by hydraulic pressure to elevate and lower the said elevating pipe (32);

a first hinge hole at the top of said elevating pipe (32) so that the first hinge shaft is connected through the first hinge hole; and a second hinge hole at the top of said elevating pipe (32) so that the second hinge shaft is connected through the second hinge hole.

3. The aerial ladder truck as claimed in claim 2, additionally comprising a plurality of elevating pipes (32) wherein an uppermost one of said pipes is the said elevating pipe of claim 2;

a plurality of lower latching plates (34) at the bottom of an outer peripheral surface of each of the plurality of elevating pipes (32); and a plurality of upper latching plates (35) latched onto the lower latching plates (34) at the top of an inner peripheral surface of each of the plurality of elevating pipes (32).

4. The aerial ladder truck as claimed in claim 2, additionally comprising a protection member (36) at the bottom of the extensible post (3), wherein the protection member (36) comprises two side plates (361) and a bottom plate (362) fixedly connected to the bed (11) to enclose and protect the bottom of the extensible post (3).

5. The aerial ladder truck as claimed in claim 1, further comprising an auxiliary deck unit 6 at the rear of the bed (11), said bed having lateral and rear edge surfaces, said auxiliary deck unit horizontally unfoldable to an outer circumference of the rear of bed (11).

6. The aerial ladder truck as claimed in claim 5, wherein the auxiliary deck unit (6) comprises:

two side plates (61) one of which is at each side of the bed (11), wherein lower ends of said side plates are fixedly connected to lateral edge surfaces of the bed (11) by hinge units to permit the side plates (61) to be horizontally unfolded to the outside of both sides;

a rear plate (62) at the rear of the bed (11), wherein a lower end of said rear plate is fixedly connected to a rear edge surface of the bed (11) by a hinge unit to permit the rear plate (62) to be horizontally unfolded to the outside; and a first connection unit (63) at the end of each side of the rear plate (62) and at the rear of the outside of each side plate (61) to separably connect both ends of the rear plate (62) to the two side plates (61).

7. The aerial ladder truck as claimed in claim 6, wherein the rear plate (62) further comprises auxiliary rear plates (64) one of which is at each side of said rear plate, wherein one of the auxiliary rear plates (64) is connected to each side of the rear of the rear plate (62) by hinge units to be horizontally unfolded, and a groove (641) in which a fixing hook is inserted is formed at a connection end of the hinge unit, a second connection unit (65) for separably connecting the rear plate (62) and unfolding ends of the auxiliary rear plates (64) is provided on each of the auxiliary rear plates (64) and the rear plate (62) to prevent the auxiliary rear plates (64) from being unfolded while the auxiliary rear plates (64) are folded in close contact with the rear of the rear plate (62), and a protruding support (611) at the rear of the outside of each side plate (61) to support the auxiliary rear plates (64) while the auxiliary rear plates (64) are horizontally unfolded.

8. The aerial ladder truck as claimed in claim 7, wherein the second connection unit (65) comprises:

a fixing hole (651) at the unfolding ends of the auxiliary rear plates (64); and a locking shaft unit (652) separately connected to the rear plate (62) to separably connect to the fixing hole (651), wherein the locking shaft unit (652) comprises:

a fixing member (652*a*) fixed to the rear plate (62), protruding brackets (652*b*) protruding rearward at the inside and outside of the fixing member (652*a*), and a horizontal through-hole in the protruding brackets (652*b*);

a horizontal locking shaft (652*c*) horizontally passing through the horizontal through-hole in the protruding brackets (652*b*), and movable to the left and right, wherein a stop ring (652*d*) is mounted between the protruding brackets (652*b*) at the inside and outside, and an outside end of the horizontal locking shaft (652*c*) is inserted into or separated from the fixing hole (651); and a spring (653) elastically mounted to the horizontal locking shaft (652*c*) between the protruding bracket (652*b*) at the outside, and the stop ring (652*d*), for constantly pressing the horizontal locking shaft (652*c*) toward the fixing hole (651).

9. The aerial ladder truck as claimed in claim 7, additionally comprising vertical fixing posts (66) located at both sides of the bed (11) at the front of the side plates (61), and third connection units (67) separably connecting the side plates (61) to the vertical fixing posts (66) and the front of the side plates (61).

10. The aerial ladder truck as claimed in claim 6, additionally comprising at least one torsion spring unit (7) at each of the lateral edge surfaces of the bed (11) for applying force to hold the side plates (61) while the horizontally unfolded side plates (61) are erected upright, and torsion spring unit (7) comprises a horizontal fixing shaft (71) protruding outwardly from the lateral edge surfaces of the bed (11); and a torsion spring (72) is inserted in the horizontal fixing shaft (71) for constantly pressing a bottom outer surface of the side plates (61), wherein one end of the torsion spring (72) is in close contact with a lateral bottom surface of the bed (11) and the other end thereof is in close contact with a bottom outer surface of the side plates (61), and at least one torsion spring unit (7) at a rear edge surfaces of the bed (11) for applying force to hold the rear plate (62) while the horizontally unfolded rear plate (62) is erected upright, and torsion spring unit (7) comprises a horizontal fixing shaft (71) protruding outwardly from the rear edge surface of the bed (11), and a torsion spring (72) inserted in the horizontal fixing shaft (71) for constantly pressing a bottom outer surface of the rear plate (62), wherein one end of the torsion spring (72) is in close contact with a rear bottom surface of the bed (11) and the other end thereof is in close contact with the bottom outer surface of the rear plate (62).

* * * * *